US011319665B2

(12) United States Patent
Baldinger et al.

(10) Patent No.: US 11,319,665 B2
(45) Date of Patent: May 3, 2022

(54) ROPE MADE OF TEXTILE FIBER MATERIAL

(71) Applicant: TEUFELBERGER FIBER ROPE GMBH, Wels (AT)

(72) Inventors: Peter Baldinger, Schwertberg (AT); Björn Ernst, Gmunden (AT); Gunter Kaiser, Thalheim/Wels (AT); Rudolf Kirth, Vöcklabruck (AT); Erich Rührnössl, Haid (AT); Robert Traxl, Ebensee (AT)

(73) Assignee: TUEFELBERGER FIBER ROPE GMBH, Wels (AT)

( * ) Notice: Subject to any disclaimer, the term of this patent is extended or adjusted under 35 U.S.C. 154(b) by 139 days.

(21) Appl. No.: 15/746,572

(22) PCT Filed: Jul. 19, 2016

(86) PCT No.: PCT/EP2016/067156

§ 371 (c)(1),
(2) Date: Jan. 22, 2018

(87) PCT Pub. No.: WO2017/013107

PCT Pub. Date: Jan. 26, 2017

(65) Prior Publication Data

US 2018/0216291 A1 Aug. 2, 2018

(30) Foreign Application Priority Data

Jul. 22, 2015 (EP) ..... 15177933

(51) Int. Cl.
*D07B 1/02* (2006.01)
*D07B 1/04* (2006.01)
(Continued)

(52) U.S. Cl.
CPC ..... *D07B 1/025* (2013.01); *D07B 1/02* (2013.01); *D07B 1/04* (2013.01); *D07B 1/14* (2013.01);
(Continued)

(58) Field of Classification Search
CPC . D07B 1/02; D07B 1/14; D07B 3/005; D07B 1/025; D07B 1/04; D07B 2201/102;
(Continued)

(56) References Cited

U.S. PATENT DOCUMENTS 2,022,683 A 12/1935 Charles et al.
2,737,075 A 3/1956 Poirier et al.
(Continued)

FOREIGN PATENT DOCUMENTS

CN 2632128 Y 8/2004
DE 20021529 U1 3/2001
(Continued)

OTHER PUBLICATIONS

International Preliminary Report on Patentability cited in PCT/EP2016/067156 dated Jan. 23, 2018.

*Primary Examiner* — Shaun R Hurley
(74) *Attorney, Agent, or Firm* — Workman Nydegger

(57) ABSTRACT

The invention relates to a rope made of a textile fibre material for applications in which a diagonal pull may occur, characterized in that the rope is a core/sheath rope the core (1) of which and the sheath of which are composed essentially of a textile fibre material the core (1) of which is stranded and which exhibits a force-fitting winding with a tensile element (2, 2', 2") between the core (1) and the sheath.

19 Claims, 2 Drawing Sheets

Figure 1:
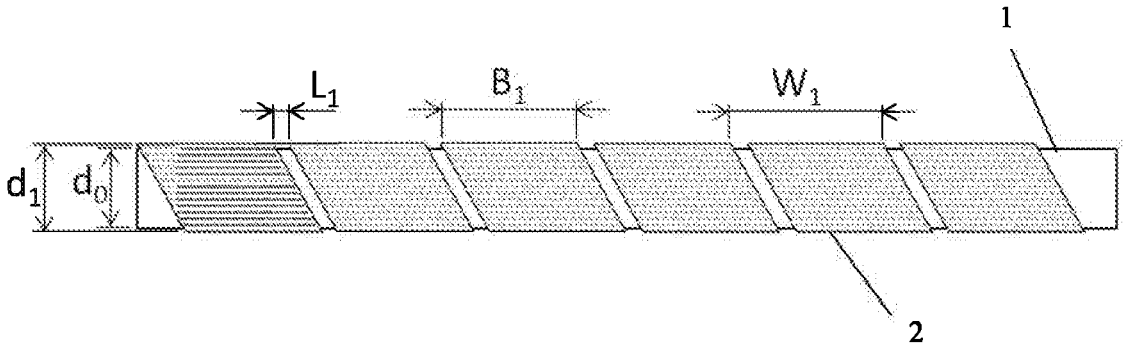

(51) Int. Cl.
*D07B 1/14* (2006.01)
*D07B 3/00* (2006.01)

(52) U.S. Cl.
CPC ..... *D07B 3/005* (2013.01); *D07B 2201/102* (2013.01); *D07B 2201/104* (2013.01); *D07B 2201/1092* (2013.01); *D07B 2201/1096* (2013.01); *D07B 2201/2003* (2013.01); *D07B 2201/2083* (2013.01); *D07B 2201/2086* (2013.01); *D07B 2201/2088* (2013.01); *D07B 2201/2089* (2013.01); *D07B 2205/20* (2013.01); *D07B 2205/201* (2013.01); *D07B 2205/205* (2013.01); *D07B 2205/2014* (2013.01); *D07B 2205/2039* (2013.01); *D07B 2205/2042* (2013.01); *D07B 2205/2046* (2013.01); *D07B 2205/2096* (2013.01); *D07B 2207/4054* (2013.01); *D07B 2401/205* (2013.01); *D07B 2401/2015* (2013.01); *D07B 2401/2055* (2013.01); *D07B 2501/2015* (2013.01)

(58) Field of Classification Search
CPC .... D07B 2201/1096; D07B 2201/2088; D07B 2201/2089; D07B 2201/209
See application file for complete search history.

(56) References Cited

U.S. PATENT DOCUMENTS 3,024,589 A * 3/1962 Vaughan ..... D02G 3/40 57/7
3,164,952 A * 1/1965 Edward ..... A63B 51/02 57/6
3,375,560 A * 4/1968 Turnbull ..... D02H 3/00 28/190
3,405,516 A * 10/1968 Laureti ..... D07B 1/02 57/211
3,422,460 A * 1/1969 Burke ..... A41B 17/00 2/73
3,457,717 A * 7/1969 Wall ..... D07B 1/162 57/233
3,911,785 A * 10/1975 Hood ..... D07B 1/04 87/1
4,019,940 A * 4/1977 Hood ..... D07B 1/04 156/148
4,568,415 A * 2/1986 Woltron ..... A63B 51/02 156/185
5,327,714 A * 7/1994 Stevens ..... A63B 51/02 273/DIG. 6
7,134,267 B1 11/2006 Gilmore et al.
2002/0136859 A1* 9/2002 Fisher ..... D02G 3/441 428/95
2006/0048497 A1* 3/2006 Bloch ..... D02G 3/06 57/230
2006/0207414 A1* 9/2006 Nye ..... D04C 1/12 87/7
2007/0209203 A1* 9/2007 McCullough ..... H02G 1/04 29/869
2009/0282801 A1 11/2009 Gilmore
2009/0288372 A1* 11/2009 Cere ..... B65B 11/025 53/461
2011/0300366 A1* 12/2011 Henssen ..... D02G 3/32 428/221
2014/0090549 A1* 4/2014 Hurlen ..... D04C 1/06 87/9
2015/0113936 A1* 4/2015 Amils ..... D07B 1/0686 57/216
2015/0128792 A1* 5/2015 Zachariades ..... D07B 1/04 87/6
2017/0328001 A1* 11/2017 Kirth ..... D07B 1/025
2018/0327968 A1* 11/2018 Boye Hansen ..... F16G 11/146

FOREIGN PATENT DOCUMENTS

WO WO9850621 11/1998
WO WO2006118465 A1 11/2006

* cited by examiner

ROPE MADE OF TEXTILE FIBER MATERIAL

The present invention relates to a rope made of a textile fibre material for applications in which a diagonal pull may occur.

It is known that in applications in which a diagonal pull occurs, ropes are twisted around their longitudinal axis.

In rope drives of cranes, but also in other applications, the arrangement of the rope sheaves causes the ropes to run up and down in many cases with a lateral fleet angle during their run over the rope sheaves. The lateral rope fleet angle, which appears between the rope and the sheave, is also referred to as a diagonal pull angle.

In particular, it is known that non-twist-free laid ropes have the tendency to untwist under load due to their "helix", unless they are fixed on both sides in a torsion-proof manner.

However, basically non-twisting ropes (which are constructed, for example, such that the torques of individual rope elements such as, e.g., braids will cancel each other out under load) may also be twisted in the occurrence of a diagonal pull.

A person skilled in the art understands by "non-twisting ropes" all ropes the twist of which is the twist <360°/1000 d in case of a non-torsion-proof attachment under a strain of $S/d^2=0$ to $S/d^2=150\ N/mm^2$, wherein d denotes the diameter of the rope (Feyrer 2000, Drahtseile, Springer Verlag).

Depending on the rope structure, a twist of the rope around its longitudinal axis leads to a load redistribution between the load-bearing elements (wires, fibres, braids etc.). As a result of said load redistribution, individual elements will be relieved of their load and other elements will be overloaded. As a result of said load redistribution between the load-bearing elements, the service life of the rope will be reduced.

Said twist of the rope may occur locally, for example in applications involving a diagonal pull, e.g., in case of multiple reeving in pulley blocks or in case of a diagonal haul-off from the drum onto the first deflection pulley, and therefore may affect also non-twisting ropes.

In fact, especially non-twisting ropes thereby experience a reduction in service life, namely more so than non-twist-free ropes, since the load redistribution between the individual braid layers is more pronounced due to the different directions of lay of the braid layers (source: Weber, Tobias: Beitrag zur Untersuchung des Lebensdauerverhaltens von Drahtseilen unter einer kombinierten Beanspruchung aus Zug, Biegung and Torsion. Dissertation Universität Stuttgart, 2013, Print-on-demand, full text: http://elib.uni-stuttgart.de/opus/volltexte/2013/8663).

Since a diagonal pull cannot be avoided structurally in many applications, a torsional rigidity as high as possible is desirable for preventing a local twist (implication for service life, see above).

WO 2015/001476 describes a pliable cable for furling a sail. The core of the cable, which may consist of a fibre material, is sheathed with rubber which comprises fibre strands running in different directions. The rubber is vulcanized so that the result will be a firm bond between the core of the cable and the rubber layer.

From EP 2 868 917 A1, a tension cable for a wind-energy generation system by means of an aircraft is known. Around the core of the rope, coils are arranged, which, optionally, may comprise signal strands or electrical strands.

CA 1234520 describes the manufacture of a cable, wherein filaments located parallel to each other are compacted and then wrapped completely by a band so as to be protected against an externally applied polyurethane coating.

From U.S. Pat. No. 7,399,018, a lifting sling is known which is surrounded by a tube made of polyurethane, which has been cut open spirally, in particular in the area of the splice.

Further prior art is known from US 2009/282801 A1, U.S. Pat. No. 2,737,075 A, WO 2006/118465 A1, DE 200 21 529 U1 as well as WO 98/50621.

It is the object of the present invention to provide a rope made of a textile fibre material which is better protected against twist in the occurrence of a diagonal pull.

Said object is achieved by a rope according to claim 1. Preferred embodiments of the rope according to the invention become apparent from the subclaims.

SHORT DESCRIPTION OF THE FIGURES

FIG. 1 schematically shows a preferred embodiment of the winding according to the invention around the core of the rope.

Figure 2:
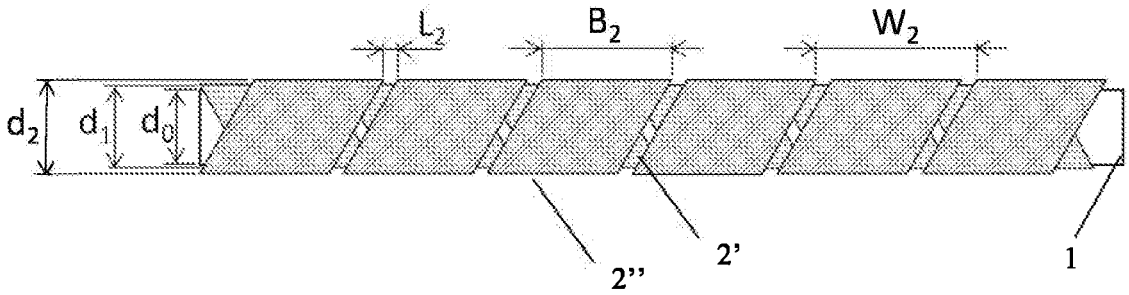

FIG. 2 schematically shows a two-ply winding around the core.

Figure 3:
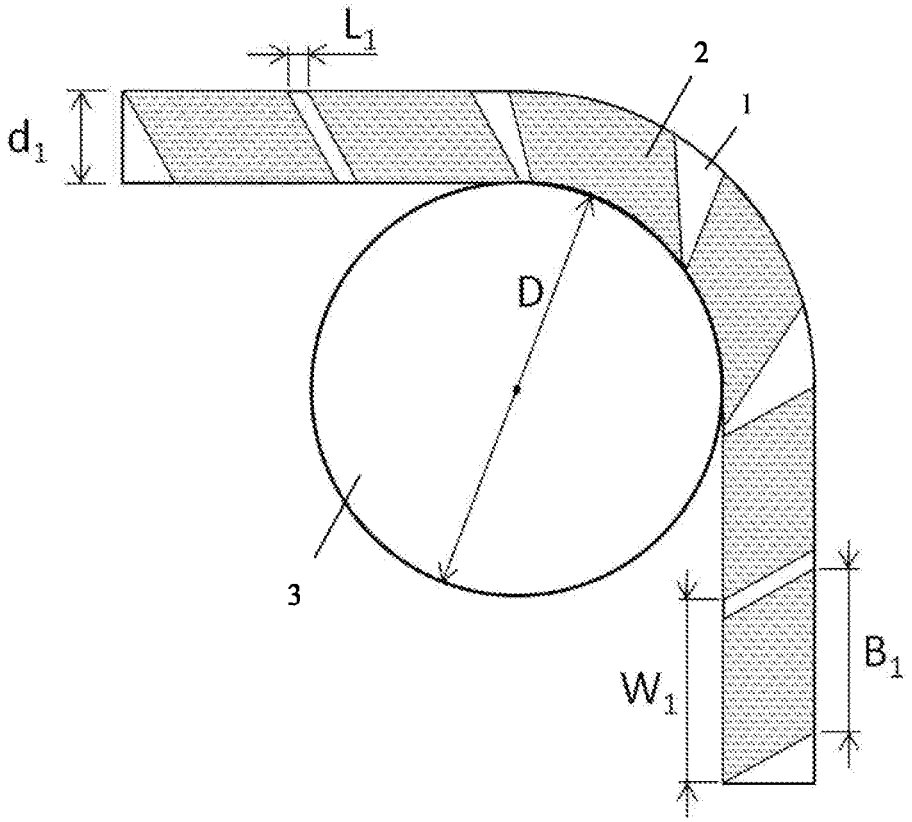

FIG. 3 schematically shows the test method for determining as to whether the gap between two windings as provided in a preferred embodiment is large enough.

DETAILED DESCRIPTION OF THE INVENTION

The present invention provides a rope made of a textile fibre material for applications in which a diagonal pull may occur, which is characterized in that the rope is a core/sheath rope the core of which and the sheath of which are composed essentially of a textile fibre material the core of which is stranded or braided and the core of which, and/or, if the core is provided in the form of several strands, at least part of the strands, preferably all strands of the core, is/are enwound by a tensile element in a force-fitting manner.

In this connection, the term "rope made of a textile fibre material" means that the essential components of the rope, in particular its load-bearing elements, consist of a textile fibre material such as, e.g., braids of synthetic fibres. The rope according to the invention may also comprise components made of other materials such as, e.g., materials impregnating the rope or rope components, or also individual non-textile bundles of a specific function, for example, for the transmission of electrical signals.

In particular, the core and the sheath of the rope are composed essentially of a textile fibre material, wherein, also in this case, additional materials are possible, for example, individual non-textile bundles.

The core of the rope according to the invention is stranded, meaning that the bundles forming the core of the rope are twisted with each other. Alternatively, the bundles of the core may be braided.

The core of the rope according to the invention may be provided as a single core, i.e., as a single strand made of bundles which are twisted or braided with each other. As an alternative, the core may be provided in the form of several strands. The strands may run next to each other in parallel or may again be twisted or braided with each other.

According to the invention, the core is enwound by a tensile element in a force fitting manner. Said winding is thus provided between the core and the sheath.

By means of said winding, it is ensured that the rope will twist as little as possible during its use, in particular in the event of the occurrence of a diagonal pull.

A "tensile element" and a "force-fitting winding" are thus understood to be elements as well as their attachment which prevent the rope from twisting as far as possible.

In doing so, the twist of the rope should be prevented merely by enwinding the core with the tensile element. An impregnation of the rope beyond that is possible, but not necessary.

If the core, as illustrated above, is made up of several strands, the winding may consist in the following possibilities:

a) the entire core (i.e., all strands jointly) is enwound b) at least part of the strands, preferably all strands, are enwound individually c) a combination of a) and b)

Preferably, the tensile element is wound around the core of the rope or, respectively, optionally the strands of the core with a pretension of at least 1%, preferably at least 2%, particularly preferably at least 3% of the maximum tensile force of the tensile element.

Due to said pretension, a particularly effective force-fitting winding for preventing the rope from twisting can be achieved.

In a further preferred embodiment of the present invention, the tensile element is wound around the core of the rope or, respectively, optionally the strands of the core in at least two winding layers. Particularly preferably, the winding layers may differ in their directions of winding.

Thus, in case of two winding layers, one layer may be wound around the rope in the "S"-direction, and the second layer placed thereupon may be wound around the rope in the "Z"-direction.

Furthermore, at least one winding within a winding layer may preferably be located with a gap from the next winding. It has been shown that spacing between the individual windings is beneficial, since the rope will have better flexibility.

In this connection, the windings do not have to be spaced apart with gaps across the entire length of the rope. It is important that gaps are provided in the area of the rope which is bent during use (e.g., over a drum or a Koepe sheave).

In doing so, the gap between two windings should preferably be chosen to be at least large enough so that it will not close when the rope is bent at a bending radius of five times the external diameter of the rope on the side of the rope which becomes shorter with bending.

Mathematically, this can be expressed by the following formula:

As a starting point, the winding length W is used which results from the width of the tensile element plus the gap located between two windings.

The gap L as a component of the winding length W or, respectively, in case of several winding layers, as a component of the respective winding length $W_n$ in the $n^{th}$ layer of the winding, is defined as follows:

$$W_n = B_n * (1 + L_n),$$

wherein the abbreviations have the following meanings:

$W_n$=winding length of the tensile element in the $n^{th}$ layer of the winding in mm $B_n$=width of the tensile element in the $n^{th}$ layer of the winding in mm $L_n$=gap of the tensile element between two adjacent windings in the $n^{th}$ layer of the winding in percent.

According to the preferred embodiment of the gap, the percentage value of the gap will then be:

$$L_n > \left\{\left[\frac{D + \frac{d_n}{2}}{D}\right] - 1\right\} * 100 = \left\{\left[\frac{10d_a + \frac{d_n}{2}}{10d_a}\right] - 1\right\} * 100,$$

wherein the abbreviations have the following meanings:

$L_n$ denotes the gap between two windings of the same winding layer in %,

D denotes the diameter of a device, e.g., a disc, around which the rope is bent, wherein D is ten times the value of the external diameter $d_a$ of the rope, $d_n$ denotes the respective external diameter of the core including winding layers up to the $n^{th}$ layer which is enwound n: number of layers of winding material $d_a$ denotes the external diameter of the rope including the sheath All length specifications are to be used in mm.

In this connection, the winding length W or, respectively, $W_n$ does not have to be constant across the length of the rope. As mentioned above, it is particularly beneficial if gaps are provided in the area of the rope which is bent during use, which gaps will then preferably comply with the above formulas. In other places, no gaps or else gaps which do not comply with the above formulas may be provided.

In a further preferred embodiment, within one winding layer, at least 30%, preferably at least 50%, particularly preferably at least 80% of the surface of the core of the rope or, respectively, optionally the strands of the core of the winding or windings is covered by the tensile element.

Particularly preferably, the tensile element provided according to the invention is provided in the form of a band.

The width of the band B therein preferably ranges from $0.5*d_n$ to $2*d_n$.

The width of the band may be constant across the various winding layers. Alternatively, bands of different widths may be used. For example, per winding layer, one band of a width different from that of the previous winding layer may be used.

The tensile element provided according to the invention preferably has a tensile strength of $F_{min} \geq \mu * S$, wherein μ denotes the coefficient of sliding friction between two layers of the tensile element, and S denotes the maximum tensile force of the rope.

The material of the core of the rope according to the invention is preferably composed of high-strength fibres. The fibres may be selected from the fibre types UHMWPE, aramide, LCP, PBO, PET, PA, PP, PE as well as mixtures thereof.

Similarly, the material of the sheath of the rope according to the invention is preferably composed of high-strength fibres which may be selected from the fibre types UHMWPE, aramide, LCP, PBO, PET, PA, PP, PE as well as mixtures thereof.

The material of the tensile element may be selected from the fibre types UHMWPE, aramide, LCP, PBO, PET, PA, PP, PE as well as mixtures thereof. Band-shaped tensile elements are preferably provided in a woven form.

The diameter of the rope according to the invention amounts to 6 mm and more, in particular up to 200 mm and more.

Preferably, the rope according to the invention is characterized in that, under a load of between 0% and 40% of its actual breaking load (according to ISO 2307), it is twisted by less than 10°/100 d, wherein d denotes the diameter of the rope including the sheath in mm.

A method characterized in that the core of the rope and/or, if the core is provided in the form of several strands, at least part of the strands, preferably all strands of the core, is/are enwound by a tensile element in a force-fitting manner, serves for the manufacture of the rope according to the invention.

Preferably, the tensile element is wound around the core of the rope or, respectively, optionally the strands of the core with a pretension of at least 1%, preferably at least 2%, particularly preferably at least 3% of the maximum tensile force of the tensile element.

Furthermore, also the core of the rope or, respectively, optionally the strands of the core is/are preferably kept at a pretension, in particular at a pretension of 0.1% to 40% of the breaking load of the core or, respectively, optionally the strands of the core, during the enwinding with the tensile element.

The present invention also relates to the use of the rope according to the invention in applications in which a diagonal pull may occur, in particular as a suspension/hauling rope in cranes, e.g., tower slewing cranes, mobile cranes, crawler cranes and offshore cranes, in hoisting winches, in particular for single-strand lifting of unguided loads and in construction equipment, e.g., drilling equipment, ramming equipment and cable dredges.

DETAILED DESCRIPTION OF THE FIGURES

FIG. 1 shows a preferred embodiment of the rope according to the invention. Therein, only the core 1 of the rope is shown schematically. The core 1 has a diameter do and is composed of a twisted or braided textile fibre material (not illustrated). In a manner known per se, the rope additionally comprises a sheath made of a textile fibre material, which is not illustrated herein. According to the invention, the core 1 is enwound by a tensile element 2, which is band-shaped in the preferred embodiment as illustrated herein. In the finished rope, the tensile element 2 is located between the core 1 and the sheath (not illustrated).

Gaps of a width $L_1$ are provided between the windings. The windings thereby exhibit a winding length $W_1$ resulting from the width $B_1$ of the tensile element 2 and the gap $L_1$. The surface of the core 1 is covered by the tensile element by 50% or more, in particular by 80% or more.

Together with this winding layer, the result is a diameter of the enwound core 1 of $d_1$.

FIG. 2 shows an embodiment with two winding layers 2' and 2". Therein, the winding layers 2' and 2" are wound around the core 1 in different directions of winding. In both winding layers, gaps are provided between the respective windings. Thus, also in the second winding layer, a winding length $W_2$ results from the width $B_2$ of the tensile element in said winding layer and the gap $L_2$ in said winding layer. Furthermore, a diameter of the enwound core 1 of $d_2$ ensues.

As mentioned above, the widths $B_1$ and $B_2$ of the tensile element may be different in the two winding layers, just like the lengths of the gaps $L_1$ and $L_2$. In addition, the lengths of the gaps $L_1$ and $L_2$ must be constant across the length of the rope, but they can vary or, respectively, may not exhibit any gaps especially in places of the rope which are not bent during use.

FIG. 3 schematically shows the measuring method by means of which it can be determined as to whether the gaps $L_1$ which are provided have the minimum length as preferred according to the invention: The core 1 around which the tensile element 2 is wound is bent over an element, e.g., a disc 3. The diameter D of the disc 3 is ten times the external diameter of the rope comprising a sheath $d_a$ (not illustrated). If the gaps $L_1$ do not close when the rope is bent over the disc 3 on the side which becomes shorter with bending, they exhibit the required minimum length and also comply with the above-indicated formulas.

The invention claimed is:

1. A rope made of a textile fibre material for applications in which a diagonal pull may occur, the rope comprising:
- a core/sheath rope comprising a core and a sheath; and
- a tensile element,
- wherein the core and the sheath are composed essentially of a textile fibre material,
- wherein the core is stranded or braided,
- wherein the core, and/or, if the core is provided in the form of several strands, at least part of the strands, is/are wrapped by a first winding layer of the tensile element in a force-fitting manner, wherein the first winding layer contacts the core and/or the strands over an entire coincident length of the first winding layer with the core and/or strands,
- wherein, within the first winding layer formed by the tensile element, a winding is located with a longitudinally extending gap ($L_1$, $L_2$) from the next winding,
- wherein the diameter of the rope is at least 6 mm, and
- wherein the material of the core of the rope is comprised of high-strength fibres selected from the fibre types UHMWPE, aramid, LCP, PBO, and mixtures thereof.

2. A rope according to claim 1, wherein the tensile element is wound around the core of the rope or, respectively, optionally the strands of the core with a pretension of at least 1% of the maximum tensile force of the tensile element.

3. A rope according to claim 1, wherein the tensile element is wound around the core of the rope or, respectively, optionally the strands of the core to additionally form at least a second winding layer.

4. A rope according to claim 3, wherein the first and second winding layers differ in their directions of winding.

5. A rope according to claim 1, wherein the gap ($L_1$, $L_2$) between two windings is chosen to be at least large enough so that it will not close when the rope is bent at a bending radius of five times the diameter of the rope on the side of the rope which becomes shorter with bending.

6. A rope according to claim 1, wherein at least 30% of the surface of the core of the rope or, respectively, optionally the strands of the core is covered by the tensile element.

7. A rope according to claim 1, wherein the tensile element is provided in the form of a band.

8. A rope according to claim 1, wherein the tensile element has a tensile strength of $F_{min} \geq \mu * S$, wherein
- μ denotes the coefficient of sliding friction between two layers of the tensile element, and S denotes the maximum tensile force of the rope.

9. A rope according to claim 1, wherein, under a load of between 0% and 40% of its actual breaking load (according to ISO 2307), the rope is twisted by less than 10°/100 d, wherein d denotes the diameter of the rope including the sheath.

10. A rope according to claim 1, wherein the tensile element is wound around the core of the rope or, respectively, optionally the strands of the core with a pretension of at least 2% of the maximum tensile force of the tensile element.

11. A rope according to claim 1, wherein the tensile element is wound around the core of the rope or, respectively, optionally the strands of the core with a pretension of at least 3% of the maximum tensile force of the tensile element.

12. A rope according to claim 1, wherein at least 50% of the surface of the core of the rope or, respectively, optionally the strands of the core of the winding or windings is covered by the tensile element.

13. A rope according to claim 1, wherein at least 80% of the surface of the core of the rope or, respectively, optionally the strands of the core of the winding or windings is covered by the tensile element.

14. The rope of claim 1, wherein the sheath of the rope is composed of fibres selected from the fibre types UHMWPE, aramid, LCP, PBO, PA, and mixtures thereof.

15. A method for the manufacture of a rope according to claim 1, wherein the core of the rope and/or, if the core is provided in the form of several strands, at least part of the strands, is/are unwound wrapped by a tensile element in a force-fitting manner.

16. A method according to claim 15, wherein the tensile element is wound around the core of the rope or, respectively, optionally the strands of the core with a pretension of at least 1% of the maximum tensile force of the tensile element.

17. A method according to claim 15, wherein the core of the rope or, respectively, optionally the strands of the core is/are kept at a pretension of 0.1% to 40% of the breaking load of the core or, respectively, optionally the strands of the core, during the enwinding with the tensile element.

18. A method of using a rope according to claim 1 in applications in which a diagonal pull may occur, the method comprising using the rope as a suspension/hauling rope in one or more of cranes, tower slewing cranes, mobile cranes, crawler cranes, and offshore cranes, in hoisting winches, for single-strand lifting of unguided loads and in construction equipment, drilling equipment, ramming equipment, and cable dredges.

19. A method of using a rope for an application in which a diagonal pull may occur, the method comprising:

providing a rope made of textile fibre material, the rope comprising:

a core/sheath rope comprising a core and a sheath, wherein the core and the sheath are composed essentially of a textile fibre material, wherein the core is stranded or braided, wherein the core, and/or, if the core is provided in the form of several strands, at least part of the strands, is/are wrapped by a tensile element in a force-fitting manner, wherein the tensile element contacts the core and/or the strands over an entire coincident length of the tensile element with the core and/or the strands, wherein, within a winding layer formed by the tensile element, a winding is located with a longitudinally extending gap ($L_1$, $L_2$) from the next winding, wherein the diameter of the rope is at least 6 mm, and wherein the rope omits any material suitable for the transmission of electrical signals; and using the rope as a suspension/hauling rope in a crane, tower slewing crane, mobile crane, crawler crane, offshore crane, or hoisting winch, for single-strand lifting of an unguided load, and/or in construction equipment, drilling equipment, ramming equipment, or cable dredges.

* * * * *